US005487618A

United States Patent [19]

Cox

[11] Patent Number: 5,487,618

[45] Date of Patent: Jan. 30, 1996

[54] BARRIER DEVICE FOR A TRAFFIC BOLLARD TO PROTECT DETACHED MOVABLE OBJECTS DURING CONTACT

[76] Inventor: Charles E. Cox, 1016 Superior St. Lot 6, Fort Myers, Fla. 33916

[21] Appl. No.: 280,078

[22] Filed: Jul. 25, 1994

[51] Int. Cl.[6] ..... E01F 15/00

[52] U.S. Cl. ..... 404/6; 404/10; 52/301; 256/13.1

[58] Field of Search ..... 404/6, 9, 10; 24/16 PB, 24/68 PP, 68 C, 459; 248/345.1; 40/606, 607; 256/10, 11, 13.1; 52/301, 515

[56] References Cited

U.S. PATENT DOCUMENTS 5,299,883 4/1994 Arth, Jr. ..... 404/10

*Primary Examiner*—Ramon S. Britts
*Assistant Examiner*—Pamela A. O'Connor

[57] ABSTRACT

A barrier device for a traffic bollard to protect movable secondary objects, such a vehicle doors, from damage during contact, such as when the doors are opened. Devices are provided which circumferentially span and connect to the bollard. Various attachment methods are taught, including the incorporation of the attachment device embedded in the device during the molding process. Alternatively, a trench design is disclosed to provide concealment of the attachment device following installation. The use of panels cut from the tread section of used vehicular tire casings is disclosed. One embodiment of this design bonds two such panels together placing the attachment apparatus secured longitudinally therebetween. Draw straps are disclosed as a practical attachment device. Printed images may be applied to the exterior surface to enhance the aesthetic appeal of the device or provide a platform for advertisement material. Similarly, a raised section in the exterior surface caused by a heat stamp process or during the molding process is possible, to form similar images.

3 Claims, 4 Drawing Sheets

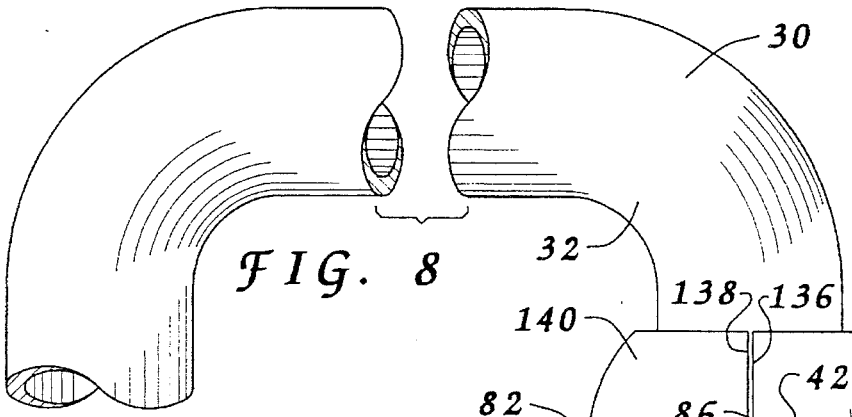
FIG. 8
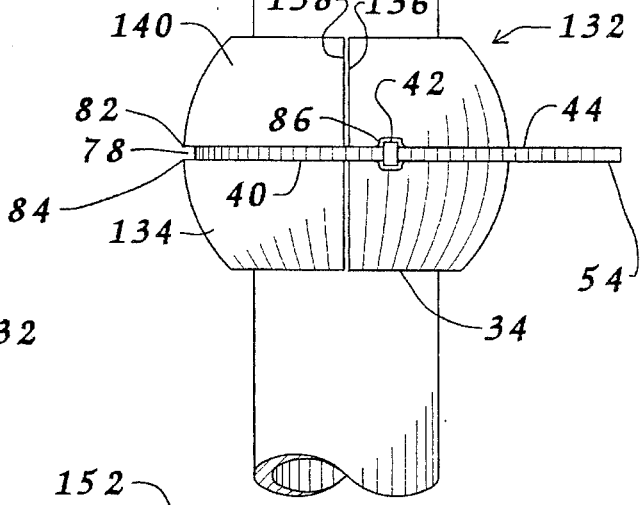
FIG. 7
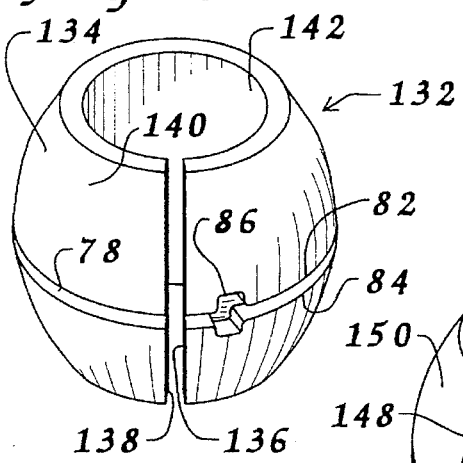
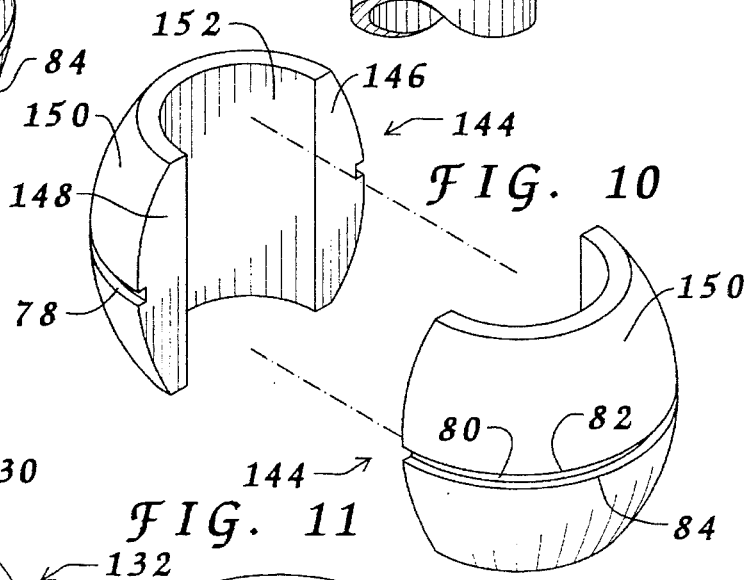
FIG. 10
FIG. 9
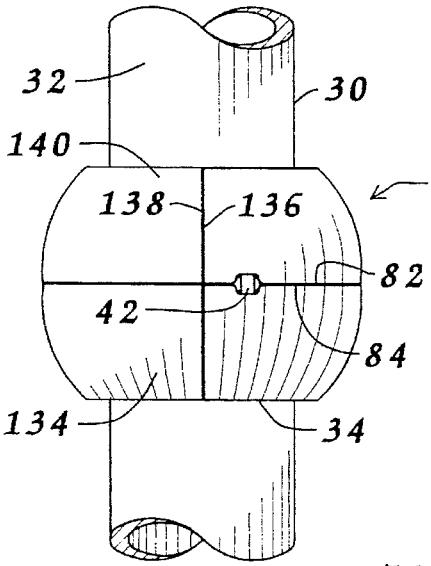
FIG. 11
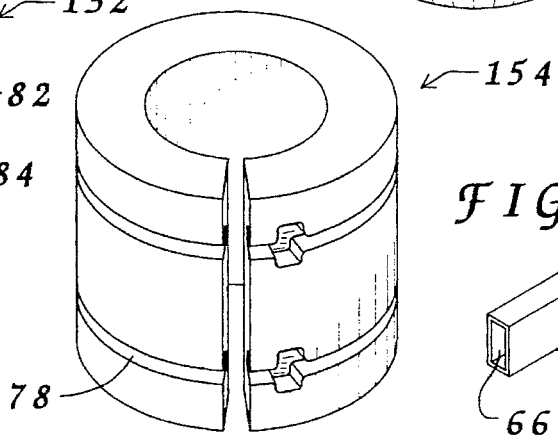
FIG. 12
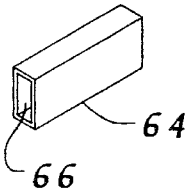

BARRIER DEVICE FOR A TRAFFIC BOLLARD TO PROTECT DETACHED MOVABLE OBJECTS DURING CONTACT

BACKGROUND

Traffic bollards are stationary barriers that provide protection to various adjacent structures. Installed in locations which have frequent vehicular traffic, such as, amongst others, toll booths, gasoline alleys and drive up tellers aisles, the bollards restrict the vehicles to the designated locations of travel. The bollards applicable to the present invention are cylindrical metal pipes of various diameter, which are vertically embedding in the ground, and are occasionally filled with concrete. Individual bollards are either straight, having a terminal end accessible above ground, or are in a horseshoe shape, with each end embedded in the ground without a terminal end accessible. It is in the locations which allows the vehicular occupants to dismount from the vehicle, and therefore require the opening of the vehicle doors, that damage occurs to the then laterally moving door of the vehicle. Door guards, in the form of an impact absorbing strips which are located on the vehicular doors, are known in the art. These guards are often not sufficient to prevent damage to the vehicle door, while many vehicles do not have such guards. Therefore, minor damage, such as dents and scratches, frequently occur to the doors as a result of such impacts.

Due to the placement of these traffic bollards, being generally situated around businesses, the appearance of the bollard is of significant concern to the business owner. The exterior of the traffic bollards are generally painted. Due to the frequent contact with vehicles, and particularly vehicle doors, the bollards must be repainted regularly. The appearance of the traffic bollard is less than desired between such paintings.

Disposal of used vehicular tire casings is important to waste management personnel. In the past, such casings have been burned causing air pollution, and this practice is seldom used today. Some casings are currently recycled by retreading, although this process is performed on a relatively small percentage of newly disposed casings. Landfills seldom allow disposal of used tires in the sections for ordinary refuse. Open air stockpiling, where the casings are stacked in massive piles, causes additional problems. One such problem is stagnant water, which collects in the casings. Stagnant water provides an excellent location for the breading of various insects, including mosquitos. Many unique and useful methods of disposing of used tire casings have been developed. Such uses currently use less than the entire production of used tire casings.

For the foregoing reasons, there is a need for a barrier device which can be easily and securely installed on the traffic bollard to protect movable objects from damage during minor contact with the bollard. The device should be such that a smooth exterior is provided. Additionally the connection apparatus should be concealed to reduce the possibility of injury to persons, particularly children.

SUMMARY

The present invention is directed to satisfying the need for an attractive protective device which can easily, and securely, be installed on a longitudinal portion of the traffic bollard. The device then protects movable objects from damage during minor contact with the bollard. A device having features of the present invention comprises an encircling apparatus, or body, which has a resilient shape and is formed in a mold from a compressible, impact absorbent, material. The body, once installed, acts between the bollard and the impacting object to protect both the impacting object and the surface treatment of the bollard. Concealment of the attachment device is of principal concern to eliminate any exposed objects which may injure persons, particularly children.

An alterative device, having features of the present invention, comprises a panel formed from the tread section of a used vehicular tire casing. The opposing ends of the panel would each taper outward, from the contact surface to the exposed surface, providing for the exposed surface to be longer in length than the contact surface. Thus when the panel is circumferentially wrapped around the bollard, and securely attached, the seam between the then contacting opposing ends would match. Concealment of the attachment device could be obtained by bonding two panels together with the attachment device longitudinally secured between them.

BRIEF DESCRIPTION OF THE DRAWINGS

These and other features, aspects, and advantages of the present invention will become apparent to those skilled in the art from the following description, appended claims, and accompanying drawings where;

FIG. 7 is a perspective view of another version of a barrier device embodying features of the present invention showing an impact protection device.

FIG. 8 is a front plan view of the device illustrated in FIG. 7 placed on a bollard.

FIG. 9 is a front plan view of the device illustrated in FIG. 8 following installation.

FIG. 10 is a perspective view showing another embodiment of an impact protection device, showing opposing identical devices as oriented prior to installation.

FIG. 11 is a perspective view of another embodiment of an impact protection device.

FIG. 12 is a perspective view of a tab protector.

DESCRIPTION

Figure 23:
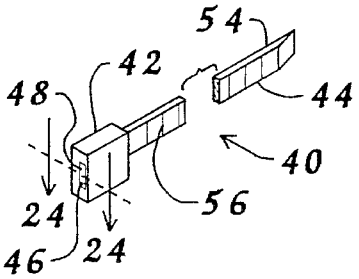
FIG. 23 PRIOR ART
FIG. 23 is a perspective view of a prior art draw strap.
Figure 24:
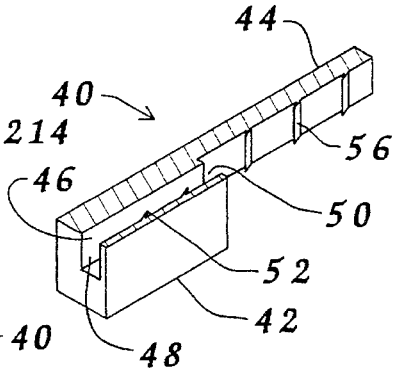
FIG. 24 PRIOR ART
FIG. 24 is a sectional perspective view as taken from the section lines shown in FIG. 23.

Referring now to the drawings where like reference numerals refer to like parts throughout the various views. Referring first to FIG. 23 and FIG. 24, a draw strap 40, as conventionally known in the art and identified as prior art, is shown. Draw strap 40 is disclosed as a simple, safe and practical attachment method throughout the various illustrated versions of the invention, and the following descriptions is applicable throughout the various views. Draw strap 40, shown with a central section cutaway in FIG. 23 and sectioned longitudinally in FIG. 24, has a locking member 42 with a flexible tab 44 extending therefrom. Flexible tab 44 has incorporated along one side a series of spaced teeth 56. Flexible tab terminates distal from locking member 42 with a pull end 54. Locking member 42 has an insertion side 48 and an exit side 50, shown in FIG. 24, which are opposing ends of a channel 46 extending through locking member 42. Channel 46 has extending therein a pivotal engagement member 52, shown in FIG. 24. Channel 46 is of sufficient dimensions to permit insertion of flexible tab 44, commencing with pull end 54, therethrough from insertion side 48. Such insertion providing for engagement of spaced teeth 56 by pivotal engagement member 52 to prevent withdraw of flexible tab 44 from insertion side 48 of locking member 42. Draw strap 40 is operable to circumferentially span and secure an outer item to an inner item having a circular cross section. To enhance strength, fibers, not shown, of various materials, can longitudinally be incorporated into draw strap 40.

Throughout the various views, bollards 30, having a periphery 32, a circumference 34 and a circular cross section 36, are shown. Periphery 32 is the exterior of bollard 30, while circumference 34 is the measurement of the distance around bollard 30. Bollard 30 is a metal pipe having a cylindrical shape and therefore has circular cross section 36. It being understood that in use, bollard 30 may have its interior area solid poured with concrete for enhanced strength, which is incidental and has no bearing upon implementation of the present invention. Terminal ends 38 are opposing ends of bollards 30. Generally bollard 30 will be straight and extend perpendicular relative to the surface into which it is installed. In this case one terminal end will be inaccessible and located below ground level, and one terminal end will be accessible and located above ground level. Occasionally bollard 30 will be so shaped that installation places both terminal ends below ground level, one such shape is shown in FIG. 8. While all of the embodiments shown are applicable if a terminal end of bollard 30 is accessible above ground level, the embodiments illustrated in FIG. 18 through FIG. 22 require a terminal end 38 to be accessible above ground level.

Figure 1:
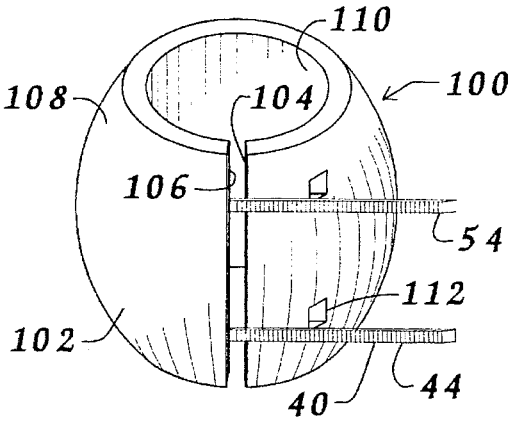
FIG. 1 is a perspective view of a barrier device embodying features of the present invention showing a protective attachment device.
Figure 2:
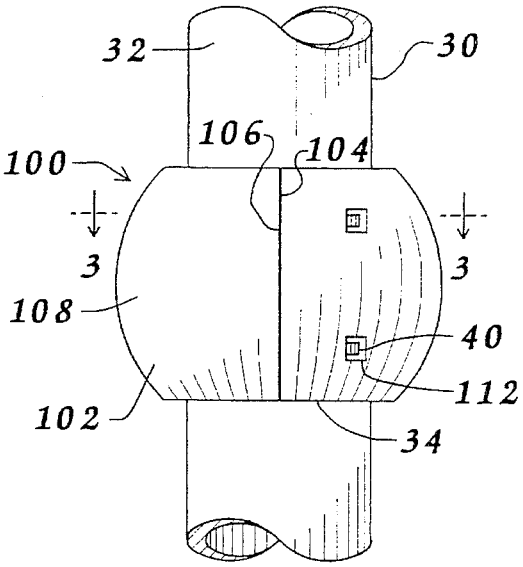
FIG. 2 is a front plan view of the device illustrated in FIG. 1 following installation.
Figure 4:
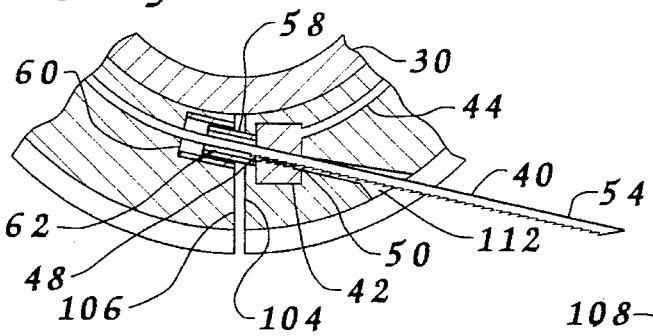
FIG. 4 is a top section view of an alternate embodiment of the device illustrated in FIG. 3 having a tab protection member.
Figure 3:
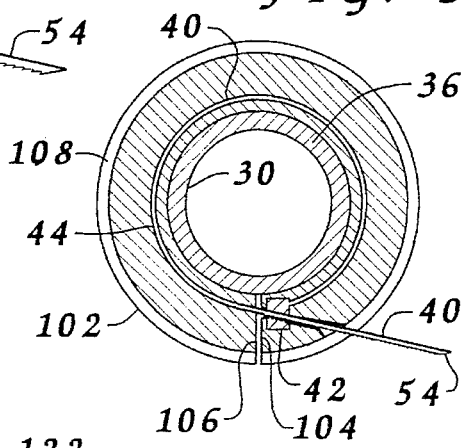
FIG. 3 is a top section view as taken from the section lines shown in FIG. 2, prior to removal of the excess flexible tab.

Referring to FIG. 1 through FIG. 4, a protective attachment device 100, comprising an encircling apparatus 102 and a pair of draw straps 40, are shown. Encircling apparatus 102 has an interior surface 110, an exterior surface 108, a first connection end 104 and a second connection end 106. Protective attachment device 100 is formed with draw strap 40 incorporated in, and an integral part of, encircling apparatus 102. Pull end 54 extends from second connection end 106, while locking member 42 is accessible from first connection end 104. As shown in FIG. 4, insertion side 48 of locking member 42 is accessible from first connection end 104 while a portal 112 extends from exit side 50 of locking member 42 to exterior surface 108 of encircling apparatus 102. Pull end 54, extending from second connection end 106, is inserted through locking member 42 to extend through portal 112 to be accessible to an installer during installation. As shown in FIG. 3, installation places encircling apparatus 102 circumferentially around bollard 30, placing first connection end 104 in close proximity to second connection end 106. Flexible tab 44 passes through locking member 42 where the installer would engage pull end 54 and tightly secure encircling apparatus 102 to bollard 30. Following installation, as shown in FIG. 2, any excess flexible tab 44 is cutoff, or otherwise removed, leaving the portion of draw strap 40 which is exposed concealed within the confines of portal 112. FIG. 4 illustrates a tab protection member 58 and a receiving member 60 which cooperate to provide protection to flexible tab 44 of draw strap 40 following installation. Tab protection member 58 is securely attached to locking member 42. Tab protection member 58 has a tunnel 62 penetrating therethrough providing access to insertion side 48 of locking member 42. Receiving member 60 is of sufficient diameter to permit insertion therein of tab protection member 58. It being recognized that vandalism occurs and that having the securement means, in this case draw strap 40, exposed and unprotected between first connection end 104 and second connection end 106 is ill advised.

Figure 5:
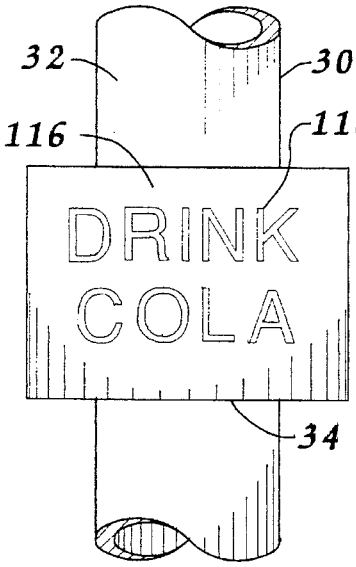
FIG. 5 is a front plan view of another embodiment of a protective attachment device.

FIG. 5 shown an alternate protective attachment device 114, having a modified geometric shape, and having an exterior surface 116 with a pattern 118 affixed thereto. It being recognized that many different geometric shapes are possible and such shaping is incidental to any of the embodiments of the invention. Pattern 118 provides for the display of decorative pictures or patterns for aesthetic appeal or for the display of advertisement.

Figure 6:
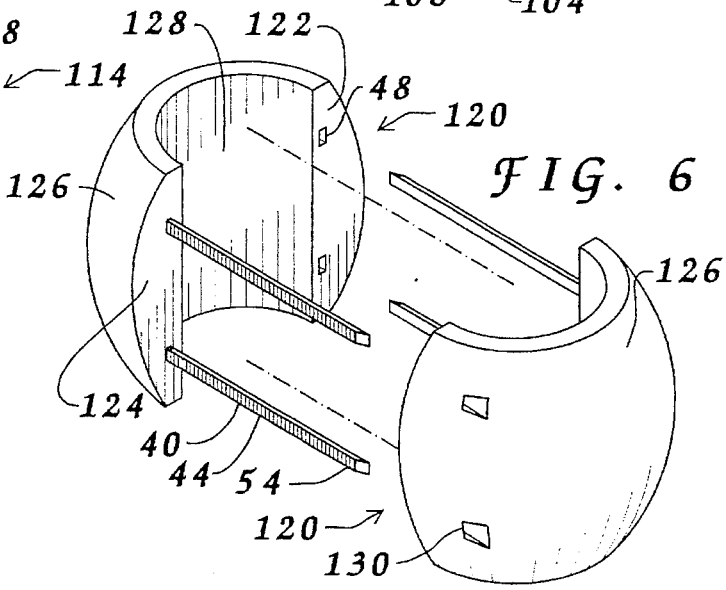
FIG. 6 is a perspective view showing another embodiment of a protective attachment device, showing opposing identical devices as oriented prior to installation.

FIG. 6 shows two sectioned protective attachment devices 120, properly positioned for installation. It being recognized that each of the two devices illustrated are identical, and would be installed in pairs as illustrated. Sectioned protective attachment device 120 is similar to protective attachment device 100, described above, having a draw strap 40 incorporated integrally into its design. Each sectioned protective attachment device 120 has a first connection end 122, a second connection end 124, an exterior surface 126 and an interior surface 128. As disclosed above, draw strap 40 extends from a locking member, not shown, having an insertion side 48 accessible from first connection end 122, circumferentially to extend outwardly from second connection end 124 in the form of flexible tab 44 having a pull end 54. Similarly as disclosed above, a portal 130 extends from exterior surface 126 to a locking member, not shown, to provide access to pull end 54 of flexible tab 44 during installation. As disclosed above a tab protection member may be utilized to reduce potential for vandalism or theft.

As disclosed above for FIG. 5, a pattern may be affixed to the exterior of the embodiments disclosed in FIG. 2 and FIG. 6.

FIG. 7, FIG. 8 and FIG. 9 show an impact protection device 132 comprising a body 134, body 134 has a first connection end 136, a second connection end 138, an exterior surface 140 and an interior surface 142. Circumferentially spanning body 134 is a trench 78 having an upper outer edge 82 and a lower outer edge 84. A receiver 86, being of slightly greater width than trench 78, is located at a predetermined location along trench 78. Following placement of impact protection device 132 on bollard 30, as shown in FIG. 8, a draw strap 40 is placed within trench 78. Locking member 42 is placed within receiver 86 and pull end 54 of flexible tab 44 is drawn tight, relative to locking member 42, to secure impact protection device 132 to bollard 30. Such tightening of draw strap 40 causes a contraction circumferentially of body 134 and brings upper outer edge 82 and lower outer edge 84 into closer proximity one to the other, if not direct contact one with the other. This contraction causes a concealment of draw strap 40. Following such installation excess flexible tab 44 is cutoff or otherwise removed, as shown in FIG. 9.

FIG. 10 shows two sectioned impact protection devices 144, properly positioned for installation. It being recognized that each of the two devices illustrated are identical, and would be installed in pairs as illustrated. Each sectioned impact protection device 144 has a first connection end 146, a second connection end 148, an exterior surface 150, an interior surface 152 and a trench 78. Trench 78 comprises a base 80, an upper outer edge 82 and a lower outer edge 84. Attachment is provided as disclosed above for FIG. 7, FIG. 8 and FIG. 9, resulting in a general concealment of the attachment means, being a draw strap.

FIG. 11 shows an alternate impact protection device 154 having one of many different geometric shapes and multiple trenches 78. Installation is fundamentally as disclosed above for FIG. 7, FIG. 8 and FIG. 9.

FIG. 12 illustrates a tab protector 64 having a passage 66. Tab protector 64 is constructed of a resilient material and allows insertion of flexible tab 44 therethrough during and following installation. Tab protector 64 is applicable to any of the embodiments illustrated in FIGS. 7, 10 or 11. Tab protector 64 would be situated within trench 78 so as to span the seam formed by the first connection end and the second connection end to reduce the chance of vandalism or theft.

As disclosed above for FIG. 5, a pattern may be affixed to the exterior of the embodiments disclosed in FIG. 7, FIG. 10 and FIG. 11.

Figure 17:
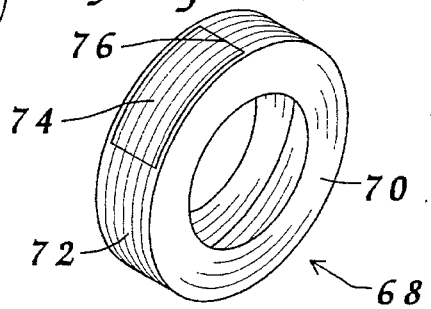
FIG. 17 is a perspective view of a used vehicular tire casing.

Referring first to FIG. 17, a used vehicular tire casing 68 is disclosed. Used vehicular tire casing 68 comprises opposing sidewalls 70 and a tread section 72. Shown is a base panel 74 having a panel boundary 76. It being understood that base panel 74 would be removed from used vehicular tire casing 68 by any of the conventional cutting methods. It being further understood that several base panels 74 could be recovered from each used vehicular tire casing 68.

Figure 13:
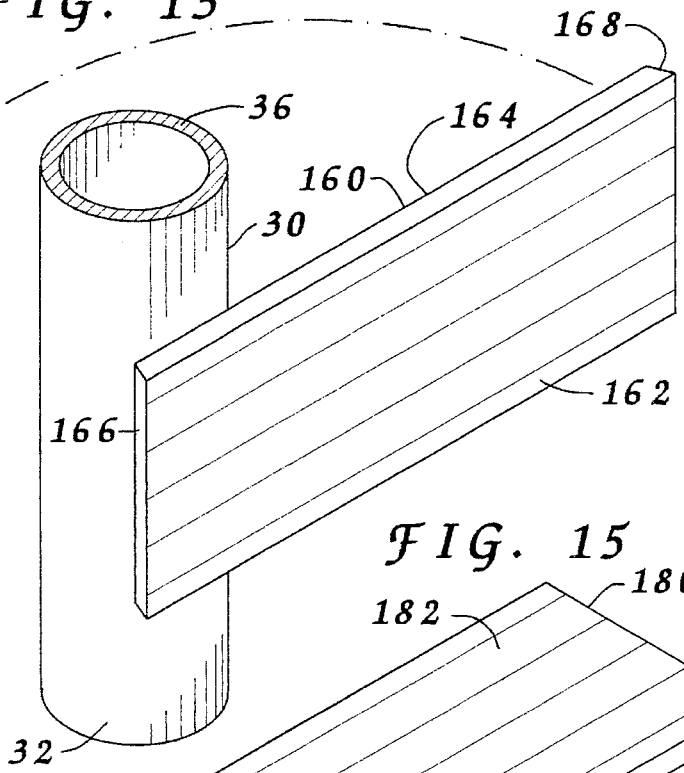
FIG. 13 is a perspective view of another version of a barrier device embodying features of the present invention showing a panel as oriented prior to installation.
Figure 14:
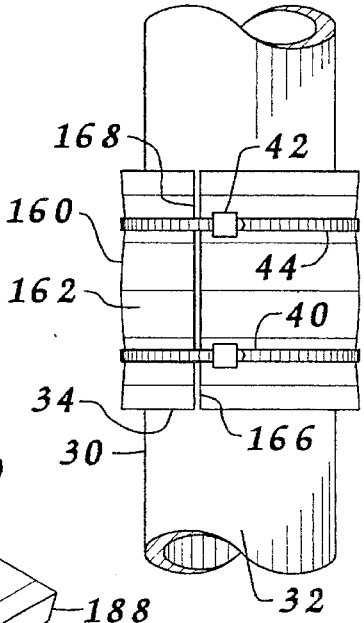
FIG. 14 is a front plan view of the panel illustrated in FIG. 13 following installation.

Referring now to FIG. 13 and FIG. 14, a panel 160 being used to act as a barrier device for a bollard 30, is disclosed. Panel 160 is formed from base panel 74, shown in FIG. 17. Panel 160 comprises an outer surface 162, an inner surface 164, a first end 166 and a second end 168. FIG. 13 shows panel 160 properly aligned with bollard 30 prior to circumferentially being wrapped around, and in contact with, periphery 32 of bollard 30. FIG. 14 shows panel 160 properly installed on bollard 30. It being noted that first end 166 and second end 168 are relatively parallel following installation, as shown in FIG. 14. This is accomplished by providing for an outward tapering of first end 166 and second end 168. Such tapering causes outer surface 162 to have a greater measurement of longitudinal length than inner surface 164. Draw straps 40 are utilized to secure panel 160 to bollard 30. Following installation any excess flexible tab 44 is cutoff or otherwise removed distal from locking member 42.

Figure 15:
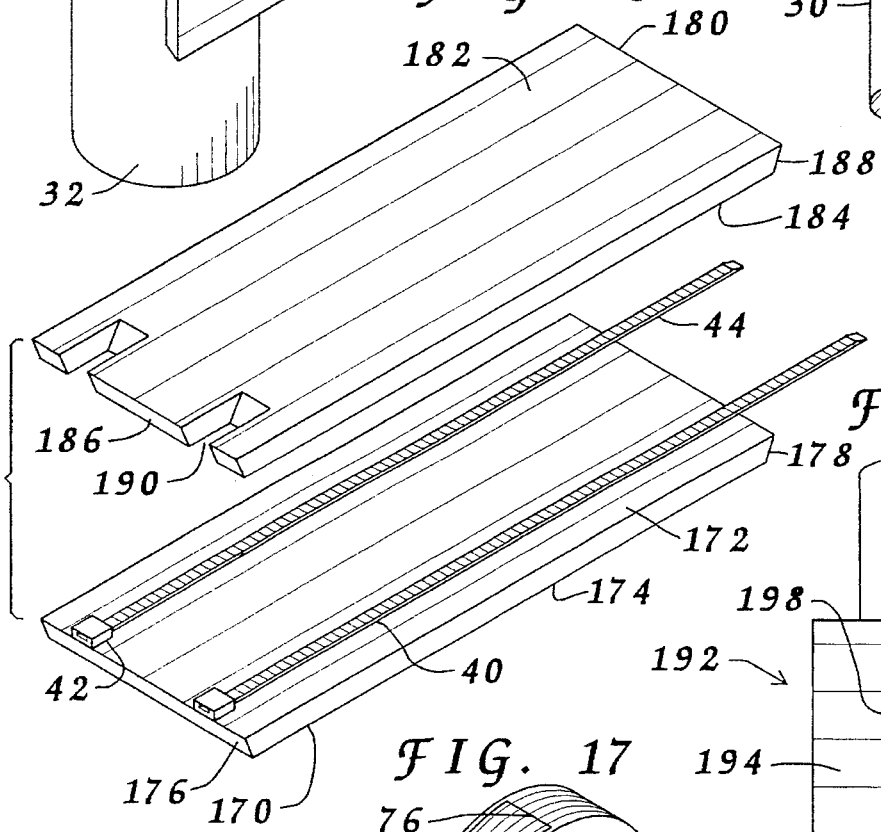
FIG. 15 is a perspective view of the construction of a bollard wrap as illustrated in FIG. 16.
Figure 16:
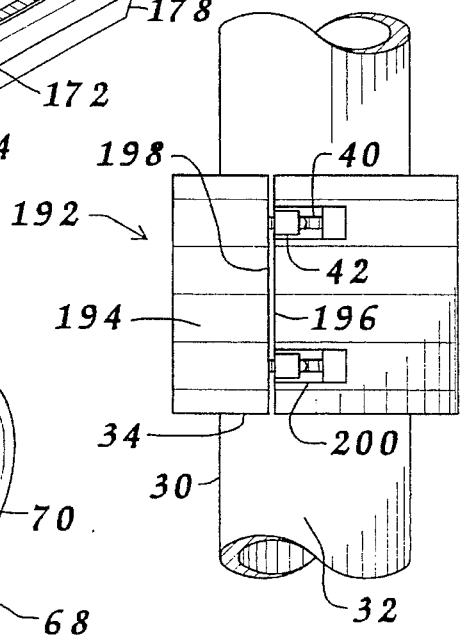
FIG. 16 is a front plan view of the bollard wrap.

FIG. 16 shows a bollard wrap 192. FIG. 15 shows the components used to construct bollard wrap 192, shown in FIG. 16. Referring to FIG. 15, an interior panel 170 comprising an outer surface 172, an inner surface 174, a first end 176 and a second end 178, are shown. It being noted that first end 176 and second end 178 taper outward from inner surface 174 to outer surface 172. Thus outer surface 172 is greater in length, measured longitudinally, than inner surface 174. An exterior panel 180 comprises an outer surface 182, an inner surface 184, a first end 186 and a second end 188, are shown suspended above interior panel 170. It being noted that first end 186 and second end 188 taper outward from inner surface 184 to outer surface 182. Thus outer surface 182 is greater in length, measured longitudinally, than inner surface 184. It being noted that inner surface 188 of exterior panel 180 is approximately equal in length, measured longitudinally, to outer surface 172 of interior panel 170. This permits a bonding of interior panel 170 to exterior panel 180. Access cutouts 190 are provided within exterior panel 180 and extend longitudinally from first end 186. Sandwiched between interior panel 170 and exterior panel 180 are two draw straps 40. Draw strap 40 comprises a locking member 42 and a flexible tab 44 extending therefrom. Draw strap 40 is positioned so that following the bonding process, locking member 42 is accessible within access cutout 190. The bonding is performed by any of the conventional methods such as adhesives or a heat process.

FIG. 16 shows bollard wrap 192 properly installed on bollard 30. Bollard wrap 192 comprises an outer surface 194, a first end 196, a second end 198 and an access area 200. Due to the outward tapering of the ends of the panels used to form bollard wrap 192, as disclosed above, first end 196 and second end 198 align one to the other following installation without angular gaping. Following installation excess flexible tab 44, of draw strap 40, is cutoff or otherwise removed. Access area 200 provides for a flush, non extending placement of locking member 42.

As disclosed above for FIG. 5, a pattern may be affixed to the exterior of the embodiments disclosed in FIG. 14 and FIG. 16.

Figure 18:
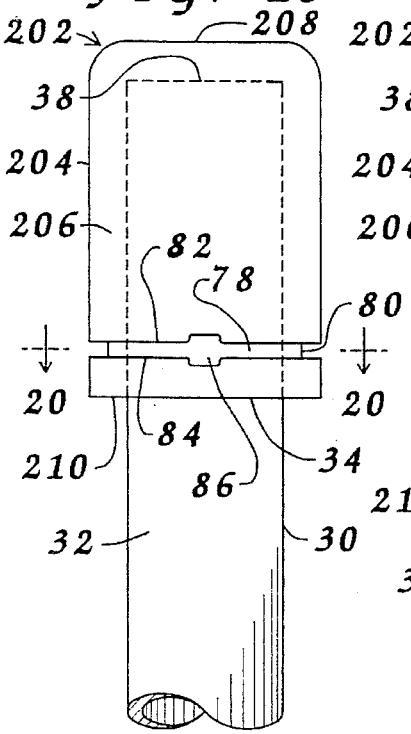
FIG. 18 is a front plan view of another version of a barrier device embodying features of the present invention showing an impact protection boot.
Figure 19:
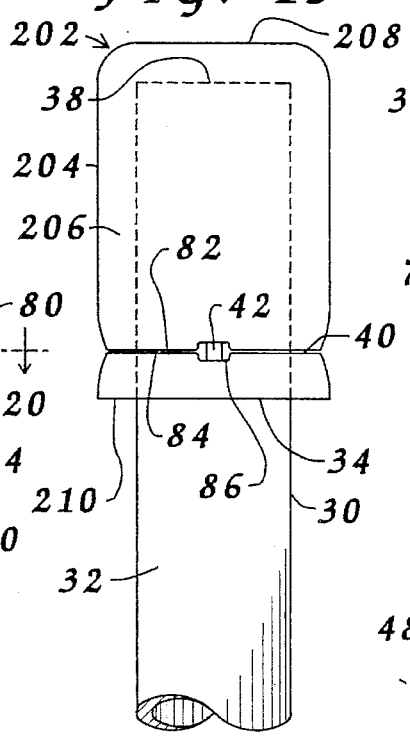
FIG. 19 is a front plan view of the boot illustrated in FIG. 18 following installation.
Figure 20:
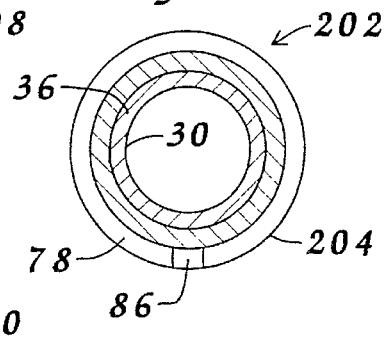
FIG. 20 is a top sectional view as taken from the section lines shown in FIG. 18.

FIG. 18, FIG. 19 and FIG. 20 show an impact protection boot 202 having a body 204, an exterior surface 206, a top end 208, a bottom end 210 and a trench 78. Top end 208 is closed while bottom end 210 is open. Installation occurs by placing impact protection boot 202 over bollard 30 by inserting terminal end 38 of bollard 30 into bottom end 210, which is open. Insertion continues until terminal end 38 of bollard 30 has penetrated impact protection boot 202 to the farthest possible extent. Therefore impact protection boot 202 requires access to terminal end 38 of bollard 30 for installation. Trench 78 comprises a base 80, an upper outer edge 82, a lower outer edge 84 and a receiver 86. Draw strap 40, is inserted within trench 78 so as to circumferentially span impact protection boot 202. Locking member 42 would be situated within receiver 86 and draw strap 40 would be securely tightened, as shown in FIG. 19. Such tightening would cause a contraction of body 204 and cause upper outer edge 82 and lower outer edge 84 to be brought into close proximity one to the other. This action would provide for a concealment of the attachment means being draw strap 40. Following installation, any excess length of draw strap 40 is cut off, or otherwise removed.

Figure 21:
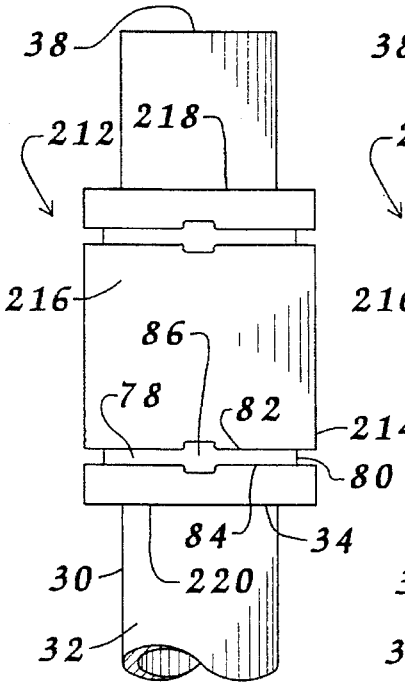
FIG. 21 is a front plan view of an impact protection sleeve.
Figure 22:
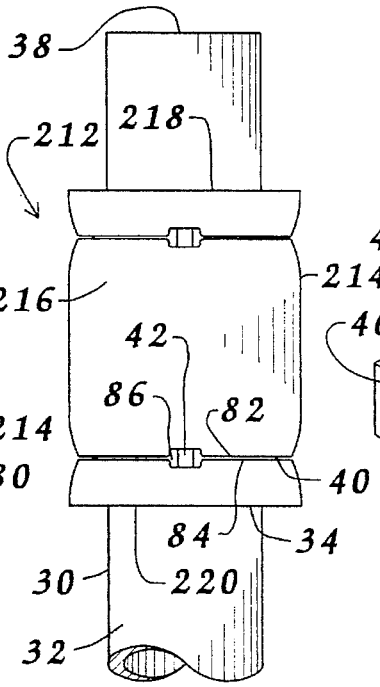
FIG. 22 is a front plan view of the impact protection sleeve illustrated in FIG. 21 following installation.

FIG. 21 and FIG. 22 show an impact protection sleeve 212 having a body 214, an exterior surface 216, a top end 218, a bottom end 220 and a trench 78. Top end 218 and bottom end 220 are both open. Installation occurs by placing impact protection sleeve 212 on bollard 30 by placing bottom end 220 over terminal end 38 and sliding impact protection sleeve 212 to a desired location of attachment. Trench 78 comprises a base 80, an upper outer edge 82, a lower outer edge 84 and a receiver 86. Following such placement draw strap 40 is placed within each trench 78 and tightened to secure impact protection sleeve 212 to bollard 30. Locking member 42 is situated within the confines of receiver 86, and draw strap 40 would be securely tightened, as shown in FIG. 22. Upon tightening upper outer edge 82 and lower outer edge 84 are drawn into close proximity one to the other. This action causes a concealment of draw strap 40. Following installation, any excess length of draw strap 40 is cut off or otherwise removed.

As disclosed above for FIG. 5, a pattern may be affixed to the exterior of the embodiments disclosed in FIG. 19 and FIG. 22.

To enhance the attachment means disclosed, an adhesive could be applied to the interior of any of the versions of barrier devices disclosed, to the exterior surface of the bollard at the location of attachment or both during installation.

Advantages of the invention

The previously described embodiments of the present invention have many advantages, including providing for the protection of the impacting item as well as the surface treatment of the bollard. Providing for the ability to easily install a barrier device with a minimum of equipment. Additionally providing for an attractive barrier upon which advertisement may be displayed. Further providing for the concealment of the attachment means which is of principal concern to reduce safety concerns which may result from exposed fasteners.

Alternatives and closing

While the use of the tread section of used vehicular tire casings has been disclosed, a heat molding process may be employed to modify the shape or surface characteristics of the tire casing. Similarly wire, as commonly used in steel belted tires, may be removed prior to, or during, the molding process.

While draw straps have been disclosed as an effective and practical attachment means, various other fasteners may be employed.

While single devices which completely encircle the bollard and sectioned devices which span one half of the bollard, and are deployed in pairs, have been disclosed, multiple sections are envisioned. Three, four or more sections may cooperate to span the bollard, and such is envisioned and disclosed. While relatively short devices, measured along the bollards longitudinal length, have been used for illustrative purpose, devices which span a significantly greater length, if not the entire exposed surface of the bollard, are envisioned and disclosed.

While many specific structural details have been disclosed, it will be understood that it is capable of many modifications, and this application is intended to cover any variation, uses, or adaptations of the invention, following in general the principles of the invention and including such departures from the present disclosure as to come with the knowledge of customary practice in the art, and as may be applied to the essential features hereinbefore set forth and falling within the scope of the invention or the limits of the appended claims.

I claim:

1. An impact protection sleeve to be secured to a bollard, the bollard of the type protecting stationary objects from vehicular contact, the bollard having a terminal end, a circular cross section, a periphery, a determinable location of attachment, the terminal end being an end accessible above ground level, the determinable location of attachment being the desired position for installation of the protective attachment device, the bollard having a circumference measured at the determinable location of attachment, the protective attachment device to provide impact absorbing properties to protect secondary, movable objects from damage during contact with the bollard, the impact protection device comprising:

a) a body, the body formed substantially of a compressible, impact absorbent material, the body having a resilient shape, an interior surface, an exterior surface, a trench, a top end, a bottom end, the resilient shape being cylindrical, the interior surface having a circumference, the interior surface to be in contact with the periphery of the bollard following attachment, the exterior surface providing impact absorbing protection for the movable objects being protected form contact with the bollard following attachment, the trench formed in the exterior of the body and axially extending circumferentially around the body relatively parallel to the bottom end of the body, the trench having an upper outer edge, a lower outer edge and a base, the base of the trench offset from the interior surface of the body, the bottom end open of the body to permit installation of the body over the terminal end of the bollard;

b) a draw strap to secure the body to the bollard, the draw strap placed within the trench during installation, the draw strap having a locking member and a flexible tab, the flexible tab extending from the locking member and terminating with a pull end, the locking member having a channel and a pivotal engagement member, the channel having an insertion side and an exit side, the channel forming a passage through the locking member, the pivotal engagement member penetrating the channel, the extending tab having incorporated thereon spaced teeth, the locking member adaptable to receive through the channel form the insertion side a portion of the tab in a unidirectional manner permitting insertion therethrough while providing for engagement of the locking member to engage the teeth of the tab to prohibit removal of the portion of the tab inserted therethrough, the draw strap causing contraction of the trench to bring the upper outer edge of the trench in close proximity to the lower outer edge of the trench following installation;

whereby the impact protection device would be secured to the bollard to provide impact absorbing protection to other detached movable objects which may impact the bollard during normal movement of the other objects.

2. The impact protection sleeve defined in claim 1 wherein the top end of the body is open to permit installation of the body on the bollard at a location spaced from the terminal end of the bollard.

3. The impact protection sleeve defined in claim 1 wherein the top end of the body is closed to permit installation of the body on the bollard such that the entire interior surface of the body is in contact with the periphery of the bollard with the terminal end of the bollard covered by the body following installation.

* * * * *